United States Patent [19]

Zelina, Jr.

[11] 4,383,145

[45] May 10, 1983

[54] MATRIX SWITCH

[75] Inventor: John H. Zelina, Jr., Fairview, Pa.

[73] Assignee: Lighting Systems, Inc., Erie, Pa.

[21] Appl. No.: 284,406

[22] Filed: Jul. 17, 1981

Related U.S. Application Data

[63] Continuation of Ser. No. 97,397, Nov. 26, 1979, abandoned.

[51] Int. Cl.[3] ..... H01H 15/02

[52] U.S. Cl. ..... 200/16 D

[58] Field of Search ..... 200/16 C, 16 D, 60, 200/292

[56] References Cited

U.S. PATENT DOCUMENTS

| | | | |
|---|---|---|---|
| 3,371,168 | 2/1968 | Milner | 2090/16 D |
| 3,670,117 | 6/1972 | Yancey | 200/16 C |
| 3,846,596 | 11/1974 | Wolf | 200/16 D |
| 3,934,101 | 1/1976 | Jones | 200/16 D X |
| 3,971,903 | 7/1976 | Wilentchik | 200/16 C |

*Primary Examiner*—J. R. Scott

*Attorney, Agent, or Firm*—Charles L. Lovercheck; Wayne L. Lovercheck; Dale R. Lovercheck

[57] ABSTRACT

A switch having a plate like matrix with laterally spaced longitudinally extending bores extending from one end of the plate to the other and wires resting in the bores with bare parts of the wires extending through the bores and insulating parts of the wires received in notches at one end of the plate. The plate has openings in one side communicating with the bare wires so that a slider sliding on the plate engages the wires through the openings forming contact with the wires and connecting the wires together at the proper positions of the slider thereby providing a switch for electrically connecting the wires together at selected positions of the slider on the plate.

9 Claims, 12 Drawing Figures

MATRIX SWITCH

REFERENCE TO PRIOR APPLICATION

This application is a continuation of patent application Ser. No. 97,397, filed Nov. 26, 1979 now abandoned.

REFERENCE TO PRIOR ART

U.S. Pat. Nos. 3,971,903, 3,670,117, 3,934,101, 3,371,168, 3,846,596 were cited. None of these references show a simple switch where wires form a part of a circuit extends through the switch and are engaged by an interval spring actuator.

GENERAL STATEMENT OF THE INVENTION

The object of the matrix switch is to provide a system whereby any practical number of switching combinations can be achieved. The matrix switch is unique in that it utilizes solid conductor wire for the switch contacts. This wire can be extended and run directly from the switch to the circuit thus eliminating the termination of a circuit wire at the switch.

The solid wire can be considered the "row elements" and the closing (or actuating) contacts the "column elements" in the matrix. By design of the plastic (or any non-conductive material) housing which secures the "row elements", connection (closing or shorting the corresponding circuit points) of any two or more "row elements" can be achieved by exposing the solid wire in the desired position. When a "row element" is not to be connected at a certain position the housing is designed so that it has an insulating barrier between the "row elements" and the "column elements" thus insulating the two from each other.

By design of the housing, any number of "row elements" can be used and any number of "column elements" can be used, making it possible to switch any number of given circuits.

Switch positioning (detenting) is performed by the semi-spherical protrusion of the actuating (column element) member engaging an opening in the surface it is riding against, thus allowing the protrusion to position itself in this opening and locking the actuator in place. In this system the actuating member allows itself to flex and give the detent a spring action.

GENERAL DESCRIPTION OF THE DRAWINGS

DETAILED DESCRIPTION OF THE DRAWINGS

Figure 1:
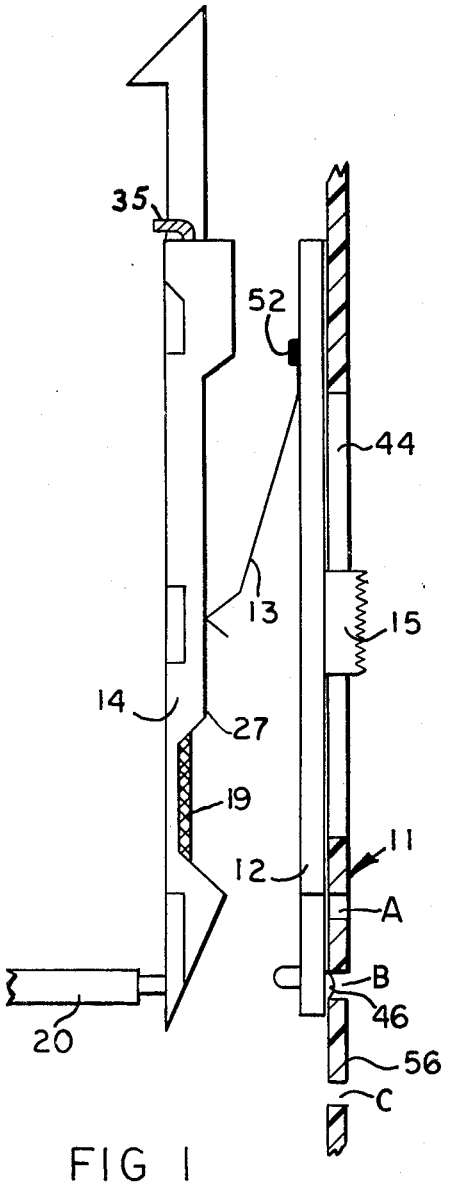
FIG. 1 is a side view of the matrix of the dual switch showing a partial support.
Figure 2:
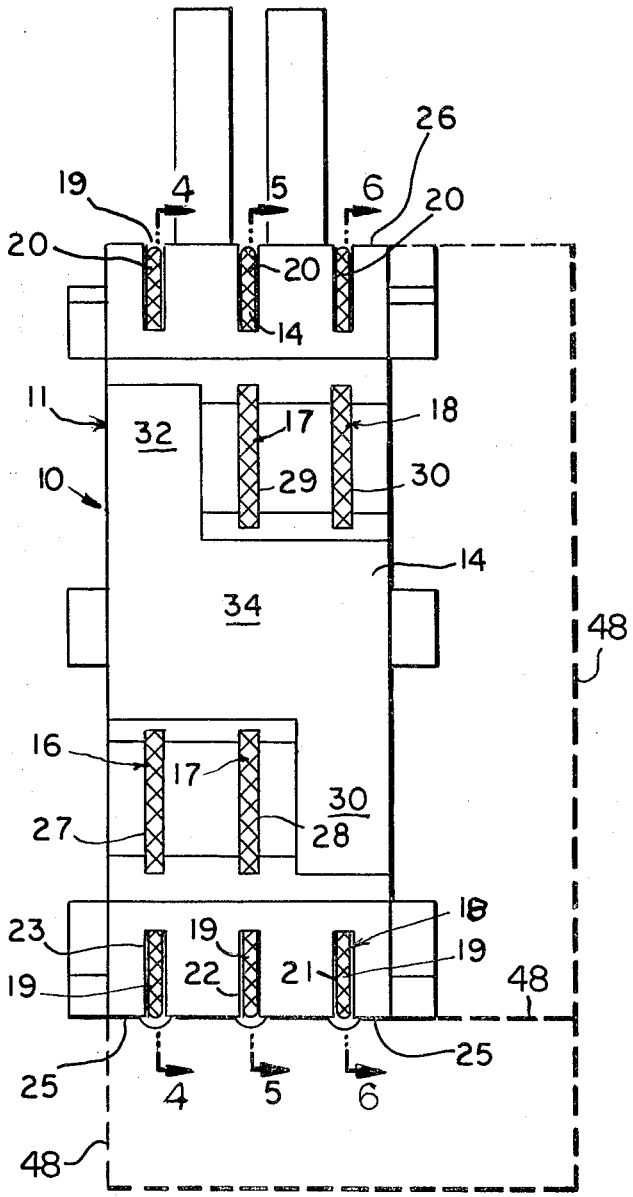
FIG. 2 is a top view of the matrix shown in FIG. 1.
Figure 3:
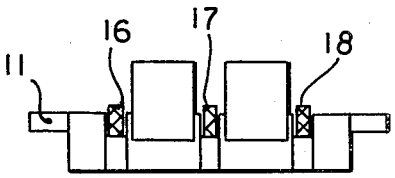
FIG. 3 is an end view of the matrix shown in FIG. 2.
Figure 4:
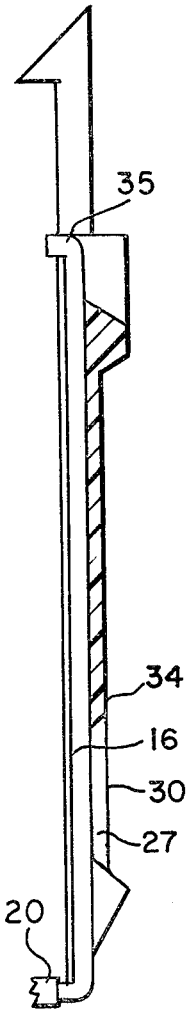
FIG. 4 is a cross-sectional view taken on Line 4—4 of FIG. 2.
Figure 5:
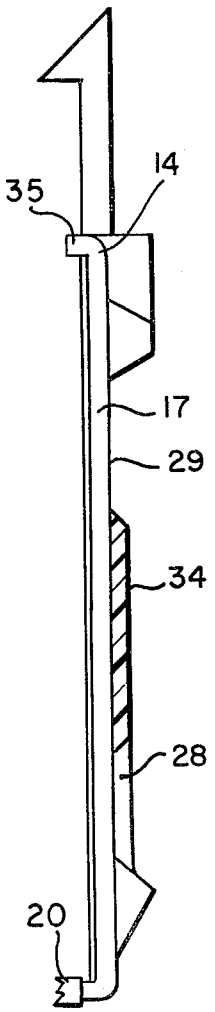
FIG. 5 is a cross-sectional view taken on Line 5—5 of FIG. 2.
Figure 6:
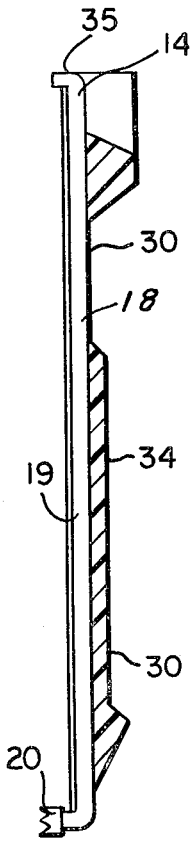
FIG. 6 is a cross-sectional view taken on Line 6—6 of FIG. 2.
Figure 7:
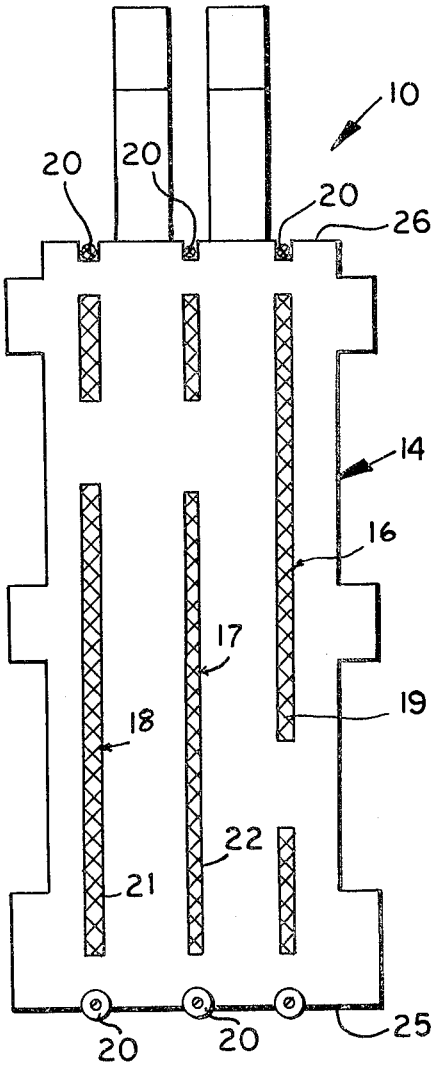
FIG. 7 is a bottom view of the matrix shown in FIGS. 1 and 2.
Figure 8:
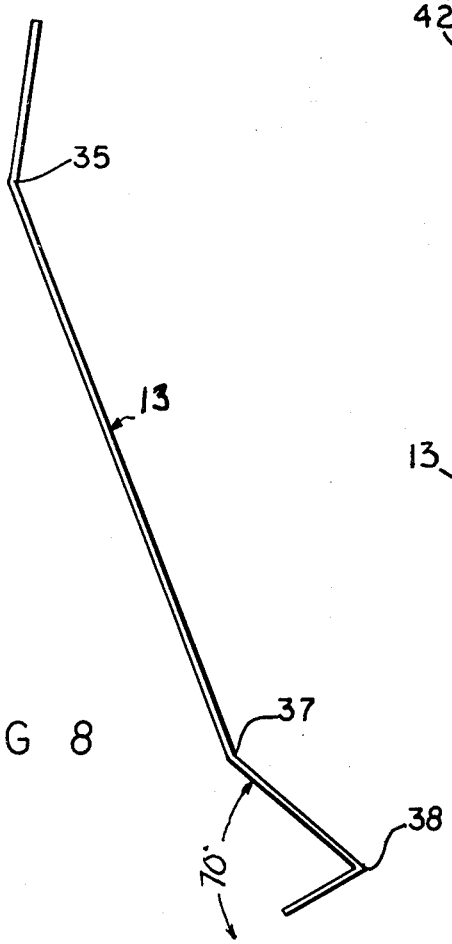
FIG. 8 is a side view of the spring brush of the actuator.
Figure 9:
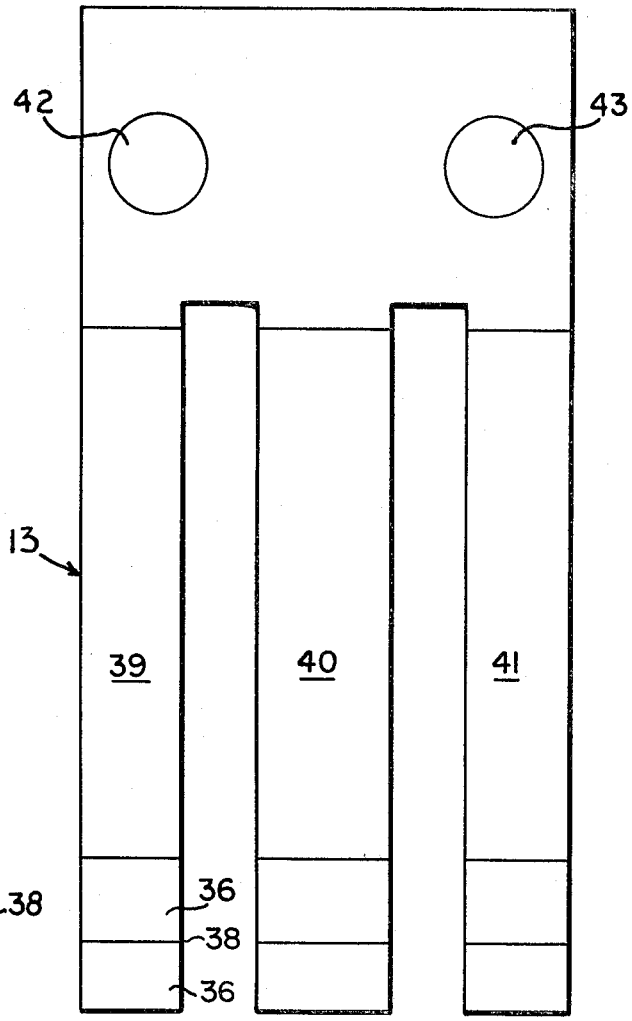
FIG. 9 is a top view of the spring brush shown in FIG. 8.
Figure 10:
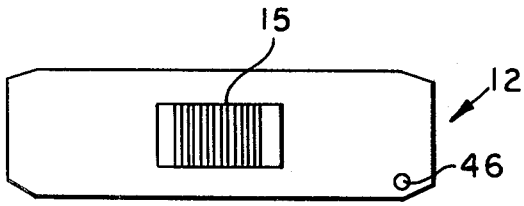
FIG. 10 is a top view of the switch actuator.
Figure 12:
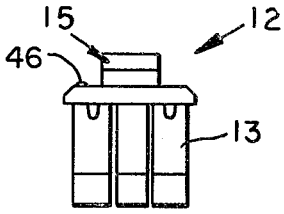
FIG. 12 is an end view of the actuator.
Figure 11:
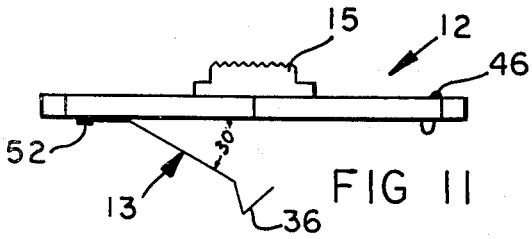
FIG. 11 is a side view of the actuator shown in FIG. 10.

Now, with more particular reference to the drawings, a switch 10 is shown made up of a body 11 having a platelike matrix 14. The matrix 14 has laterally spaced longitudinal extending bores extending from a first end 25 of the matrix to the second end 26. The wires 16, 17 and 18 have insulated parts 20 and uninsulated parts. The uninsulated parts extend through the bores and the uninsulated parts are received in notches at one end of the matrix. At the other end of the matrix the wires 16, 17 and 18 are bent upwardly at right angles thereby holding the wires rigidly in the matrix 14.

The bare parts of the wires terminate in the ends that are bent at right angles 35 to the parts of the wires received in the notches. First openings 27 and 28 are formed in the top of the matrix and these first openings communicate with the bores exposing the first bare part of wire 16 and the second bare part of wire 17. Second openings 29 and 30 are formed adjacent to the end 26 of the matrix and these openings communicate with the bores and expose the bare parts of wires 17 and 18. A flat part 32 of the matrix is disposed alongside the opening 28 and an intermediate flat part 34 is disposed between the two openings 29 and 30 and a flat space 34 is disposed longitudinally adjacent the intermediate part of the matrix and a flat portion 30 is disposed alongside the openings 27 and 28. An actuator 12 is slidably supported on the body and the actuator button 15 is formed on the actuator 12 for engaging the thumb of an operator and a contact spring 13 is attached to the actuator slide 12 by means of lug 52. A detent 46 is formed on the top of the slide 12 to locate the slide and a metallic spring 13 is attached to the bottom of the slide by means of the boss 52. The spring has three spaced fingers integrally attached to it indicated at 39, 40 and 41 and each of these fingers has a V-shaped apex 38 formed by the bend 36 in the end of the spring. V-shaped part 38 of the springs slide over the surface 34 of the body and in a first position, one finger 39 rests on the area 32 of the matrix 14. The finger 40 rests on the exposed part of wire 17 in the opening 29 and the finger 41 rests on the exposed part of wire 18 in opening 30 thereby connecting wires 17 and 18 together. In an intermediate position of the slider 15, all three fingers 39, 40 and 41 rest on the surface 34 of the matrix 14 and in the third position the fingers 39 and 40 rest on the exposed parts of wires 16 and 17 in the opening 27 and 28 and the finger 41 rests on the flat part 30 of the matrix 14. Thus, it will be seen that in the first position the actuator connects wire 17 and 18 are connected together and in a second position it connects wire 16 and 17 and in the intermediate position none of the wires are connected together, thus providing a three position switch made up of a minimum number of parts. It will also be seen that the end 35 of the wire is bent at right angles with the ends of the bare parts of the wire rigidly in position where they are exposed to the metallic slider 13.

Spring 13 is attached to slider 12 by projections 52 on the slider, which extend through holes 42 and 43. The switch may be installed by attaching the matrix to the reflector of a flashlight, for example, and attaching the slider to the case 56 of the flashlight so that it can slide between the matrix and the case 56. Then when the reflector is assembled to the flashlight case, the fingers 39, 40 and 41 are in position to slide over the top of the matrix 14. Slider 12 can slide in a plane parallel to the plane of the matrix 14.

The button 15 will extend through a slot 44 in the case and when the slider is pushed to position to bring the detent 46 into hole "C", the fingers 39 and 40 will engage wires 16 and 17 through notches 27 and 28 connecting these wires 16 and 17 together, but finger 41 will rest on the insulating surface 30. When the slider 15 is pushed to the "B" position, bringing the detent 46 into hole "B", fingers 39, 40 and 41 will all rest on surface 34 out of electrical contact with all three of the wires 16, 17 and 18. When the slider 15 is pushed to bring the detent 46 into hole "A", fingers 40 and 41 will engage wires 17 and 18 through holes 29 and 30 connecting them together, but fingers 39 will rest on surface 32 out of electrical contact. Additional positions of the actuator and additional wires can be added to making the matrix 14 wider and longer and providing the necessary notches for the additional fingers to extend through as indicated by the phantom lines 48.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A switch comprising a platelike matrix, said matrix having laterally spaced longitudinal extending bores extending from one end of said body to the other, wires including a first wire, a second wire and a third wire each having an insulated part and a bare part, said bare parts of said wires extending through said bores, the ends of said wires at each side of said matrix being bent generally at right angles thereto holding said wires rigidly in said bores, said insulated parts of said wires being received in notches at one end of said matrix, first openings formed in the top of said body adjacent a first end of said matrix;

said first openings communicating with said bores exposing said first wire and said second wire, second openings formed on the top of said body adjacent said second end of said matrix exposing said second wire and said third wire, an actuator slidably supported on said matrix, said actuator having a metallic contact spring attached thereto, said contact spring having three spaced fingers, said fingers being bent at approximately 30 degrees forming a V-shaped parts, said V-shaped parts being adapted to slide over said matrix from a first position to a second position and from said second position to a third position, said V-shaped parts of said spring being adapted to rest on said bare parts of said first wire and said second wire in the first position and all said fingers being adapted to rest on said matrix in a second position and said fingers being adapted to rest on said second wire and said third wire and on said matrix in a third position, thereby connecting said first wire to said second wire in a first position and to be out of contact with all of said wires in a second position and to connect said second wire to said third wire in a third position.

2. The combination recited in claim 1 wherein said third position is between said first position and said second position.

3. The switch recited in claim 2 wherein said spring is a flat platelike material having two spaced parallel slots therein and said slots divide an end of said spring into three spaced fingers integrally attached to a body part.

4. The combination recited in claim 3 wherein said fingers are bent at an acute angle to the body part.

5. In combination, a matrix, a plurality of row elements and a slider, said row elements extending through said matrix in generally parallel relation to one another, means to secure said row elements in said matrix to restrain them against sliding, a plurality of first openings in said matrix communicating with at least two said spaced row elements, and an actuator having a plurality of fingers electrically connected together, each of said fingers being adapted to engage a said row element through a said hole, said actuator being moveable from a position where at least two said fingers engage at least two said row elements thereby connecting them together to a position where said fingers are out of contact with said row elements, a second pair of said openings are formed in said matrix spaced longitudinally from said first-mentioned openings and said actuator is adapted to engage a plurality of said row elements in said first position and to engage a plurality of other said row elements in a second position.

6. The combination recited in claim 5 wherein said switch has a third position where said actuator is out of engagement with all of said row elements.

7. The combination recited in claim 6 wherein said row elements are conductors extending from at least one of the ends of said matrix.

8. The combination recited in claim 7 wherein said conductors are bent at the ends of said matrix and engage the ends of said matrix, thereby holding said row elements generally rigidly in position.

9. The combination recited in claim 7 wherein said actuator has a plurality of metallic fingers connected to one another, whereby the said row elements are contacted by said actuator and connected together.

* * * * *